US011217171B2

(12) United States Patent
Kim et al.

(10) Patent No.: US 11,217,171 B2
(45) Date of Patent: Jan. 4, 2022

(54) ORGANIC LIGHT EMITTING DISPLAY AND METHOD OF SENSING DETERIORATION OF THE SAME

(71) Applicant: LG DISPLAY CO., LTD., Seoul (KR)

(72) Inventors: Dongik Kim, Paju-si (KR); Kyoungdon Woo, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 45 days.

(21) Appl. No.: 16/030,123

(22) Filed: Jul. 9, 2018

(65) Prior Publication Data

US 2019/0035335 A1 Jan. 31, 2019

(30) Foreign Application Priority Data

Jul. 27, 2017 (KR) ..... 10-2017-0095414

(51) Int. Cl.

| | |
|---|---|
| ***G09G 3/3258*** | (2016.01) |
| ***G09G 3/3266*** | (2016.01) |
| ***G09G 3/3291*** | (2016.01) |
| ***G09G 3/3233*** | (2016.01) |

(52) U.S. Cl.

CPC ..... *G09G 3/3258* (2013.01); *G09G 3/3233* (2013.01); *G09G 3/3266* (2013.01); *G09G 3/3291* (2013.01); *G09G 2310/08* (2013.01); *G09G 2320/0233* (2013.01); *G09G 2320/0257* (2013.01); *G09G 2320/0295* (2013.01); *G09G 2320/045* (2013.01)

(58) Field of Classification Search

CPC ..... G06F 3/044; G06F 3/045; G06F 3/047
See application file for complete search history.

(56) References Cited

U.S. PATENT DOCUMENTS

2008/0238912 A1* 10/2008 Aoki ..... G09G 3/3648 345/215
2010/0201275 A1* 8/2010 Cok ..... G09G 3/3208 315/158
2011/0102061 A1* 5/2011 Wang ..... G06F 3/044 327/517

(Continued)

FOREIGN PATENT DOCUMENTS

CN 103578411 A 2/2014
CN 105206208 A 12/2015

(Continued)

*Primary Examiner* — William Boddie
*Assistant Examiner* — Jeffrey Parker
(74) *Attorney, Agent, or Firm* — Birch, Stewart, Kolasch & Birch, LLP

(57) ABSTRACT

An organic light emitting display and a method of sensing deterioration of the same are discussed. The organic light emitting display includes a display panel including a plurality of display lines, each of the display lines in which a plurality of pixels are arranged, each of the pixels including a light emitting element and a driving element, a panel driver configured to supply a gate signal and a data voltage synchronized with the gate signal to the pixels of the display lines, a sensing unit configured to sense driving characteristics of the pixels, and a timing controller configured to control operation timings of the panel driver and the sensing unit, and overlappingly shift a sensing driving sequence for at least some display lines in accordance with a line sequential manner.

22 Claims, 13 Drawing Sheets

(56) References Cited

U.S. PATENT DOCUMENTS

| | | | | |
|---|---|---|---|---|
| 2014/0253502 | A1* | 9/2014 | Cho | G06F 3/0446 345/174 |
| 2016/0071445 | A1* | 3/2016 | Kim | G09G 3/006 345/212 |
| 2016/0291793 | A1* | 10/2016 | Yang | G06F 3/0416 |
| 2017/0132977 | A1 | 5/2017 | Kim | |
| 2017/0193923 | A1 | 7/2017 | Park et al. | |

FOREIGN PATENT DOCUMENTS

| | | | |
|---|---|---|---|
| CN | 105321456 | A | 2/2016 |
| CN | 106328062 | A | 1/2017 |
| JP | 2010-511183 | A | 4/2010 |
| JP | 2017-120409 | A | 7/2017 |
| KR | 10-2016-0007971 | A | 1/2016 |
| KR | 10-2016-0007973 | A | 1/2016 |
| KR | 10-2017-0012734 | A | 2/2017 |
| WO | WO 2008/065584 | A1 | 6/2008 |
| WO | WO 2016/145915 | A1 | 9/2016 |

* cited by examiner

ORGANIC LIGHT EMITTING DISPLAY AND METHOD OF SENSING DETERIORATION OF THE SAME

This application claims the priority benefit of Korean Patent Application No. 10-2017-0095414 filed on Jul. 27, 2017 in the Republic of Korea, the entire disclosure of which are hereby incorporated by reference herein for all purposes.

BACKGROUND OF THE INVENTION

Field of the Invention

The present disclosure relates to an organic light emitting display, and more particularly, to an organic light emitting display and a method of sensing deterioration of an organic light emitting diode (OLED) of the display.

Discussion of the Related Art

An active matrix organic light emitting diode display includes organic light emitting diodes (OLEDs) capable of emitting light by themselves and has many advantages, such as a fast response time, a high emission efficiency, a high luminance, a wide viewing angle, and the like.

In the general OLED display, an OLED serving as a self-emitting element includes an anode electrode, a cathode electrode, and an organic compound layer (HIL, HTL, EML, ETL, EIL) between the anode electrode and the cathode electrode. The organic compound layer includes a hole injection layer HIL, a hole transport layer HTL, an emission layer EML, an electron transport layer ETL, and an electron injection layer EIL. When a power voltage is applied to the anode electrode and the cathode electrode, holes passing through the hole transport layer HTL and electrons passing through the electron transport layer ETL move to the emission layer EML and form excitons. As a result, the emission layer EML generates visible light.

The OLED display includes pixels, each including an OLED, that are arranged in a matrix form and adjusts a luminance of the pixels based on a grayscale of video data. Each pixel includes a driving thin film transistor (TFT) controlling a pixel current flowing in the OLED based on a voltage (Vgs) between a gate electrode and a source electrode of the driving TFT. Each pixel adjusts the display grayscale (luminance) by an amount of emitted light of the OLED which is proportional to the pixel current.

The OLED has deterioration characteristics in that an operating point voltage (threshold voltage) of the OLED shifts and the emission efficiency decreases as the emission time elapses. The operating point voltage of the OLED can vary from pixel to pixel depending on the degree of the OLED deterioration. When the OLED deterioration deviation occurs between the pixels, an image sticking phenomenon can occur due to a luminance deviation.

In order to compensate for the image quality degradation due to the luminance variations, a compensation technique for sensing the OLED deterioration and modulating digital image data based on the sensed value is known. In conventional compensation techniques, the OLED deterioration sensing operation is performed independently for each color. For example, when first to fourth color pixels exist in a display panel, after sensing the first color pixels for all display lines of the display panel, the second color pixels are sensed for all the display lines, and subsequently, after sensing the third color pixels for all the display lines, the fourth color pixels are sensed for all the display lines. Here, the display line means an aggregate of the first to fourth color pixels arranged next to each other along one line.

Generally, the operating point voltage of the OLED is sensed in a screen idle state, i.e., a state of that system power is applied but a screen is off. Since the operating point voltage of the OLED is sensed after emitting the OLED, the display line at which the operating point voltage of the OLED is sensed must be visible to a user's eyes. In order to minimize these side effects, it is important to reduce a sensing time. However, since the number of the display lines increases as a display device gradually becomes large-area and high-resolution, it is difficult to reduce the sensing time.

SUMMARY OF THE INVENTION

Accordingly, an object of the present disclosure is to provide an organic light emitting display and a method of sensing deterioration of the same that can reduce a sensing time in sensing deterioration of an OLED.

In one aspect, there is provided an organic light emitting display including a display panel including a plurality of display lines, each of the display lines in which a plurality of pixels are arranged, each of the pixels including a light emitting element and a driving element, a panel driver configured to supply a gate signal and a data voltage synchronized with the gate signal to the pixels of the display lines, a sensing unit configured to sense driving characteristics of the pixels, and a timing controller configured to control operation timings of the panel driver and the sensing unit, and overlappingly shift a sensing driving sequence for at least some display lines in accordance with a line sequential manner.

The sensing driving sequence can include an initialization period for setting a pixel current flowing in the driving element, a boosting period for storing an operating point voltage of the light emitting element depending on the pixel current in a parasitic capacitor of the light emitting element after the initialization period, and a sampling period for sampling the operating point voltage of the light emitting element after the boosting period.

The display panel can include a first display block and a second display block that are continuously driven for sensing. Each of the first display block and the second display block can have K (K is a natural number of 2 or more) display lines sequentially driven for sensing in accordance with the sensing driving sequence. Initialization periods of second to Kth display lines which are driven for sensing can be sequentially shifted within a boosting period of a first display line which is driven for sensing.

A sampling period of the Kth display line which is driven for sensing in the first display block and an initialization period of the first display line which is driven for sensing in the second display block can be non-overlapped.

The panel driver can sequentially supply a data voltage for on-driving for setting the pixel current to pixels of the display lines belonging to the first display block during a first period, and sequentially supply a data voltage for off-driving for blocking the pixel current to the pixels of the display lines belonging to the first display block during a second period after the first period. Initialization periods of the display lines belonging to the first display block can be included in the first period, and sampling periods of the display lines belonging to the first display block can be included in the second period.

The panel driver can sequentially supply a first gate pulse synchronized with the data voltage for on-driving to the pixels of the display lines belonging to the first display block during the first period, and sequentially supply a second gate pulse synchronized with the data voltage for off-driving to the pixels of the display lines belonging to the first display block during the second period after the first period.

The panel driver can sequentially supply a data voltage for on-driving to pixels of the display lines belonging to the second display block during a third period, and sequentially supply a data voltage for off-driving to the pixels of the display lines belonging to the second display block during a fourth period after the third period. Initialization periods of the display lines belonging to the second display block can be included in the third period, and sampling periods of the display lines belonging to the second display block can be included in the fourth period.

The panel driver can sequentially supply a first gate pulse synchronized with the data voltage for on-driving to the pixels of the display lines belonging to the second display block during the third period, and sequentially supply a second gate pulse synchronized with the data voltage for off-driving to the pixels of the display lines belonging to the second display block during the fourth period after the third period.

The timing controller can overlappingly shift the sensing driving sequence for all the display lines in accordance with the line sequential manner.

An initialization period of each of the display lines to be driven for sensing in a subsequent order can be set to be within a boosting period of each of the display lines to be driven for sensing in an immediately previous order.

The panel driver can sequentially supply a data voltage for on-driving for setting the pixel current to pixels of the display lines during the initialization period of each of the display lines, and sequentially supply a data voltage for off-driving for blocking the pixel current to the pixels of the display lines during the sampling period of each of the display lines.

The panel driver can sequentially supply a first gate pulse synchronized with the data voltage for on-driving to the pixels of the display lines during the initialization period of each of the display lines, and sequentially supply a second gate pulse synchronized with the data voltage for off-driving to the pixels of the display lines during the sampling period of each of the display lines.

In another aspect, there is provided a method of sensing deterioration of an organic light emitting display including a display panel including a plurality of display lines, each of the display lines in which a plurality of pixels are arranged, each of the pixels including a light emitting element and a driving element, where the method includes a panel driving step of supplying a gate signal and a data voltage synchronized with the gate signal to the pixels of the display lines, sensing driving characteristics of the pixels, and controlling operation timings of the panel driving step and the sensing, and overlappingly shifting a sensing driving sequence for at least some display lines in accordance with a line sequential manner.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
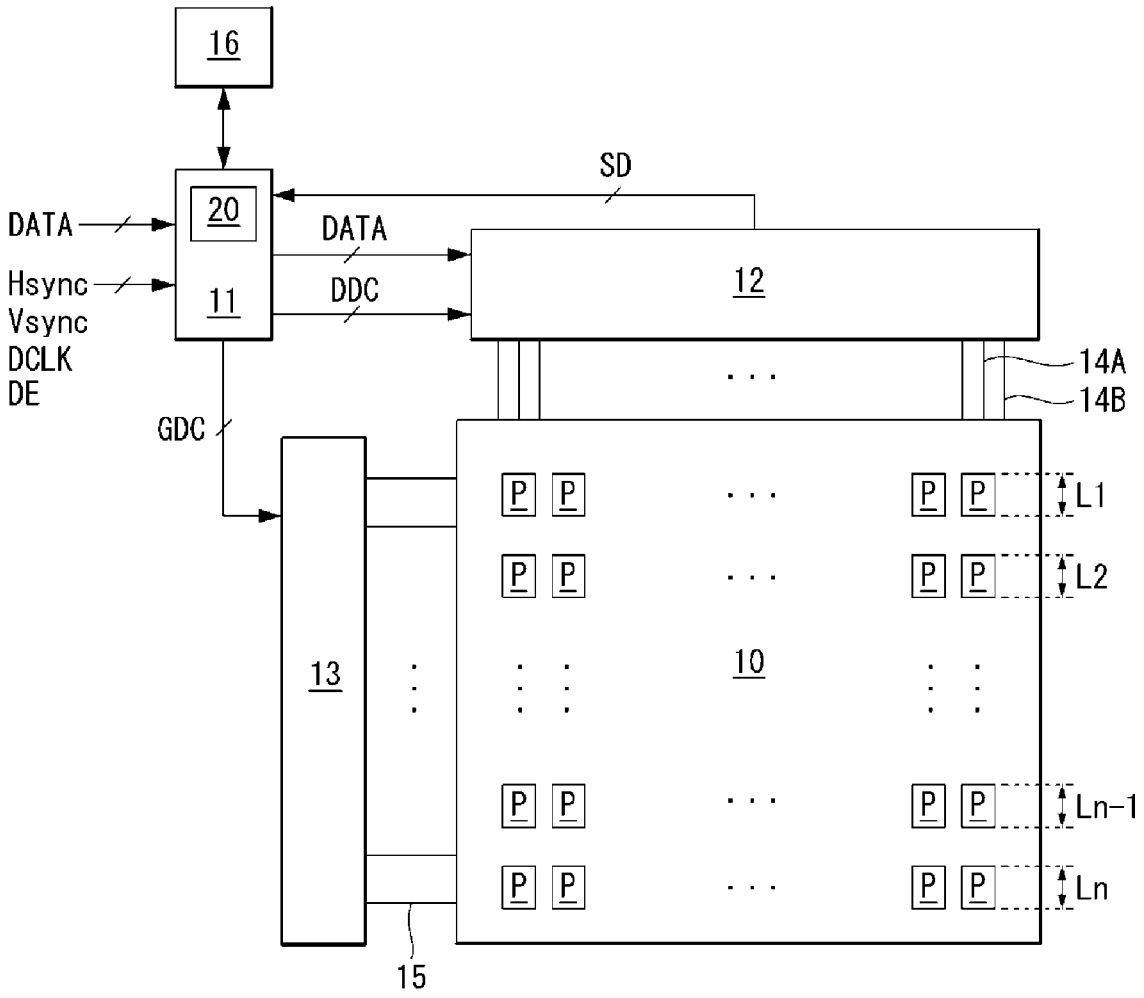
FIG. 1 is a block diagram illustrating an organic light emitting display according to an embodiment of the present disclosure.

Advantages and features of the present disclosure and methods for accomplishing the same will become apparent with reference to embodiments described in detail below with reference to the accompanying drawings. However, the present disclosure is not limited to the embodiments disclosed below, and can be implemented in various forms. These embodiments are provided so that the present disclosure will be exhaustively and completely described, and will fully convey the scope of the present disclosure to those skilled in the art to which the present disclosure pertains. The present disclosure is defined by the scope of the claims.

Shapes, sizes, ratios, angles, number, and the like illustrated in the drawings for describing embodiments of the present disclosure are merely exemplary, and the present disclosure is not limited thereto. Like reference numerals designate like elements throughout the description. In the following description, when a detailed description of well-known functions or configurations related to this document is determined to unnecessarily cloud a gist of the invention, the detailed description thereof will be omitted. In the present disclosure, when the terms "include", "have", "comprised of", etc. are used, other components can be added unless "~ only" is used. A singular expression can include a plural expression as long as it does not have an apparently different meaning in context.

In the explanation of components, even if there is no separate description, it is interpreted as including an error range.

In the description of position relationship, when a structure is described as being positioned "on or above", "under or below", "next to" another structure, this description should be construed as including a case in which the structures contact each other as well as a case in which a third structure is disposed therebetween.

The terms "first", "second", etc. can be used to describe various components, but the components are not limited by such terms. These terms are only used to distinguish one component from another component.

The features of various embodiments of the present disclosure can be partially combined or entirely combined with each other, and is technically capable of various interlocking and driving. The embodiments can be independently implemented, or can be implemented in conjunction with each other.

Hereinafter, various embodiments of the invention will be described in detail with reference to the accompanying drawings.

Figure 2:
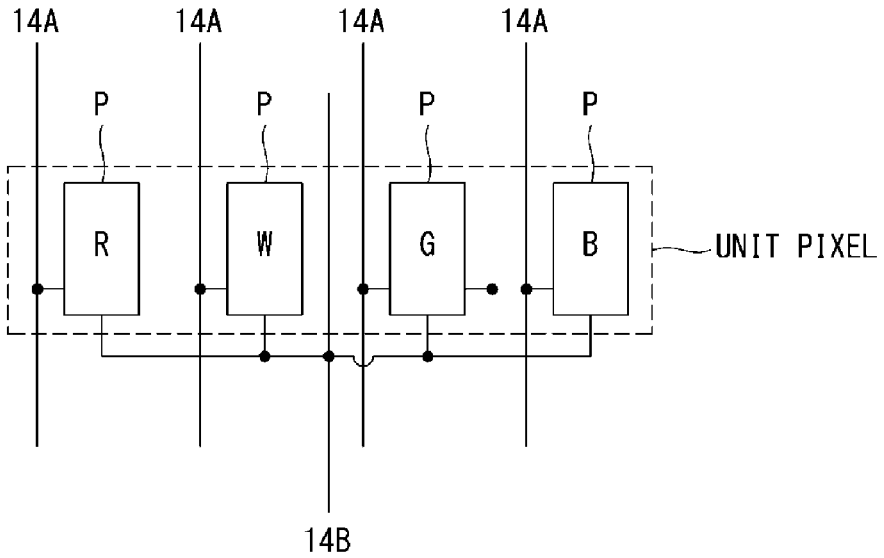
FIG. 2 is a view showing an example of connection of a sensing line and a sub-pixel of FIG. 1.
Figure 3:
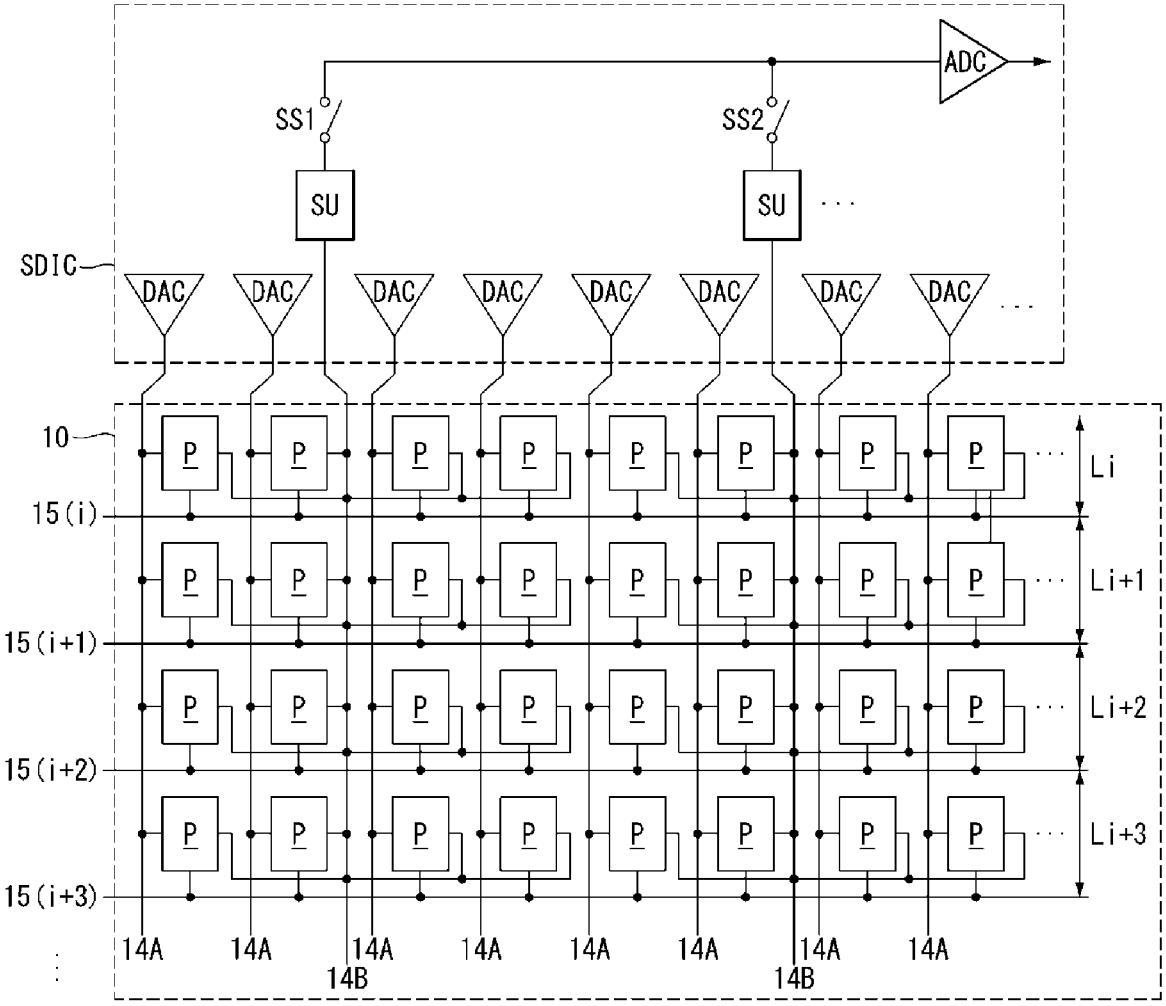
FIG. 3 is a view showing an example of the configuration of a pixel array and a data driver IC in an organic light emitting display according to an embodiment of the present disclosure.

FIG. 1 is a block diagram illustrating an organic light emitting display according to an embodiment of the present disclosure. FIG. 2 is a view showing an example of connection of a sensing line and a pixel of FIG. 1. FIG. 3 is a view showing an example of the configuration of a pixel array and a data driver IC of FIG. 1. All the components of the organic light emitting display according to all embodiments of the present disclosure are operatively coupled and configured.

Referring to FIGS. 1 to 3, the organic light emitting display according to an embodiment of the present disclosure includes a display panel 10, a timing controller 11, a data driving circuit 12, a gate driver 13, a memory 16, a compensation unit 20, and a sensing unit SU.

In the display panel 10, a plurality of data lines 14A and sensing lines 14B intersect with a plurality of gate lines 15. Pixels P are arranged in a matrix form for each of the intersection areas.

Two or more pixels P connected to different data lines 14A can share the same gate line and the same sensing line. For example, as shown in FIG. 2, an R pixel for red display, a W pixel for white display, a G pixel for green display, and a B pixel for blue display, which are connected to the same gate line and are adjacent to each other in the horizontal direction, can be commonly connected to one sensing line 14B. A sensing line sharing structure in which the sensing line 14B is allocated to each of a plurality of pixel columns facilitates securing an aperture ratio of the display panel 10. Under the sensing line structure, the sensing lines 14B can be arranged one by one for each of the plurality of data lines 14A. In the figure, the sensing line 14B is shown as being parallel to the data line 14A, but can also be disposed to intersect with the data line 14A.

The R pixel, the W pixel, the G pixel, and the B pixel can constitute one unit pixel as shown in FIG. 2. However, the unit pixel can be composed of the R pixel, the G pixel, and the B pixel.

Each of the pixels P is supplied with a high level driving voltage EVDD and a low level driving voltage EVSS from a power supply generator. The pixel P of the present disclosure can have a circuit structure suitable for sensing deterioration of a light emitting element due to environmental conditions such as a lapse of driving time and/or a panel temperature. A circuit configuration of the pixel P can be variously modified. For example, the pixel P can include a plurality of switching elements and at least one storage capacitor in addition to the light emitting element and a driving element.

The timing controller 11 can separate a time for sensing driving from a time for display driving in accordance with a predetermined control sequence. Here, the driving for sensing is a driving for sensing an operating point voltage of the light emitting element and updating a compensation value accordingly, and the display driving is a driving for reproducing an image by writing an input image data DATA reflecting the compensation value on the display panel 10. By control of the timing controller 11, the driving for sensing can be performed in a booting period before the driving for display is started, or in a power-off period after the display driving is finished. The booting period refers to a period from a time when system power is on to a time when a display screen is turned on. The power-off period refers to a period from a time when the display screen is turned off to a time when the system power is off.

On the other hand, the driving for sensing can be performed in a state where only the screen of the display device is turned off while the system power is being applied, for example, in a standby mode, a sleep mode, a low power mode, and the like. The timing controller 11 can detect the standby mode, the sleep mode, the low power mode, and the like in accordance with a predetermined sensing process, and control all operations for the driving for sensing.

The timing controller 11 can generate a data control signal DDC for controlling an operation timing of the data driving circuit 12 and a gate control signal GDC for controlling an operation timing of the gate driver 13 based on timing signals such as a vertical synchronization signal Vsync, a horizontal synchronization signal Hsync, a dot clock signal DCLK, and a data enable signal DE input from a host system. The timing controller 11 can differently generate control signals DDC and GDC for the display driving and control signals DDC and GDC for the driving for sensing.

The gate control signal GDC includes a gate start pulse, a gate shift clock, and the like. The gate start pulse is applied to a gate stage that produces a first output to control the gate stage. The gate shift clock is a clock signal commonly input to the gate stages, and is a clock signal for shifting the gate start pulse.

The data control signal DDC includes a source start pulse, a source sampling clock, and a source output enable signal, and the like. The source start pulse controls a data sampling start timing of the data driving circuit 12. The source sampling clock is a clock signal that controls a sampling timing of data based on a rising or falling edge. The source output enable signal controls an output timing of the data driving circuit 12.

The timing controller 11 can incorporate the compensation unit 20, or the compensating unit 20 can be provided separately or as part of another element of the display device.

The compensation unit 20 receives sensing data SD of the operating point voltage of the light emitting element from the sensing unit SU during the driving for sensing. The compensation unit 20 calculates a compensation value that can compensate for a luminance deviation due to deterioration (for example, shift of the operating point voltage) of the light emitting element based on the sensing data SD and stores the compensation value in the memory 16. The compensation value stored in the memory 16 can be updated each time sensing operation is repeated, and thus a characteristic deviation of the light emitting element can be easily compensated.

The compensator 20 corrects the input image data DATA based on the compensation value read from the memory 16 during the display driving and supplies the data to the data driving circuit 12.

The data driving circuit 12 includes at least one data driver integrated circuit (IC) SDIC. The data driver IC SDIC includes a plurality of data drivers connected to each of the data lines 14A. The data driver is implemented as digital-to-analog converters DAC. The data driver DAC constitutes a panel driver together with the gate driver 13.

The data driver DAC converts the input image data DATA into a data voltage for display depending on the data timing control signal DDC applied from the timing controller 11 during the display driving and supplies it to the data lines 14A. On the other hand, the data driver DAC of the data driver IC SDIC can generate a data voltage for sensing depending on the data timing control signal DDC applied from the timing controller 11 during the driving for sensing and supply it to the data lines 14A.

Figure 6:
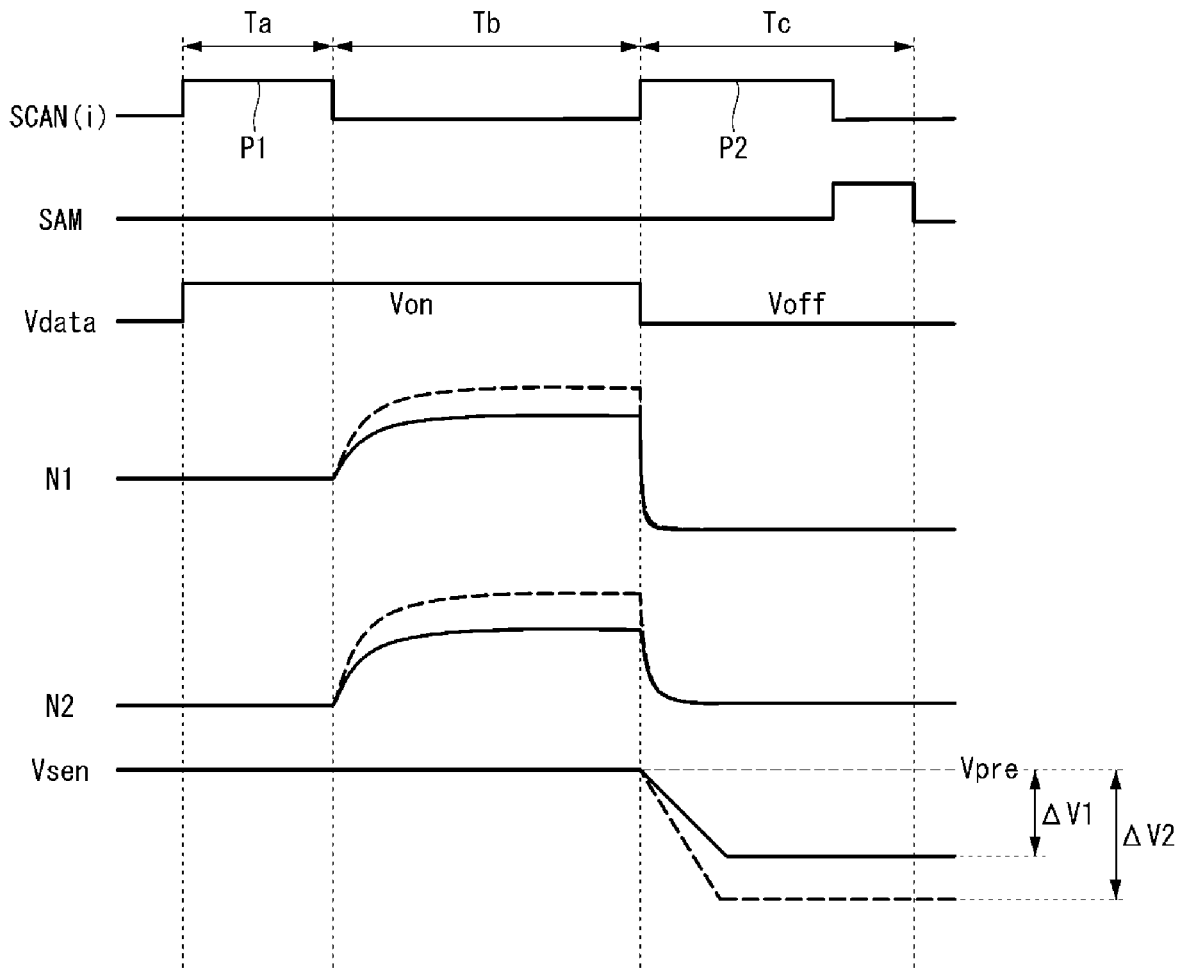

The data voltage for sensing includes a data voltage for on-driving (Von in FIG. 6) and a data voltage for off-driving (Voff in FIG. 6). The data voltage for on-driving is a voltage (i.e., a voltage for setting a pixel current) which is applied to a gate electrode of the driving element to turn on the driving element, and the data voltage for off-driving is a voltage (i.e., a voltage for blocking the pixel current) which is applied to the gate electrode of the driving element to turn off the driving element.

The data voltage for on-driving is applied to a sensing pixel to be sensed in one unit pixel, and the data voltage for off-driving is applied to non-sensing pixels sharing the sensing line 14B together with the sensing pixel in one unit pixel. For example, in FIG. 2, when R pixels are sensed and W, G, and B pixels are not sensed, the data voltage for on-driving can be applied to the driving element of the R pixel, and the data voltage for off-driving can be applied to the driving element of each of the W, G, and B pixels.

On the other hand, not only the data voltage for on-driving but also the data voltage for off-driving are applied to the sensing pixel. The data voltage for on-driving can be supplied during a period of setting the pixel current in the sensing pixel, and the data voltage for off-driving can be supplied during a period of sampling the operating point voltage of the light emitting element in the sensing pixel.

A plurality of sensing units SU can be mounted on the data driver IC SDIC.

Each of the sensing units SU can be connected to the sensing line 14B and can be selectively connected to an analog-to-digital converter ADC through mux switches SS1 to SSk. Each of the sensing units SU can be implemented as a current-to-voltage converter, such as a current integrator or a current comparator. Since each of the sensing units SU is implemented as a current sensing type, it is suitable for low current sensing and high-speed sensing. In other words, when each of the sensing units SU is configured as the current sensing type, it is advantageous to reduce sensing time and increase sensing sensitivity. The ADC can convert a sensing voltage input from each of the sensing units SU into the sensing data SD and output it to the compensation unit 20.

The gate driver 13 can generate a gate signal for sensing based on the gate control signal GDC during the driving for sensing and sequentially supply the gate signal for sensing to the gate lines 15(*i*) to 15(*i*+3). The gate signal for sensing is a scan signal for sensing synchronized with the data voltage for sensing. Display lines Li to Li+3 are sequentially driven for sensing by the gate signal for sensing and the data voltage for sensing. Here, each of the display lines Li to Li+3 means a group of R, W, G, and B pixels arranged adjacent to each other along one line. The gate signal for sensing can include a first pulse (P1 in FIG. 6) synchronized with the data voltage for on-driving and a second pulse (P2 in FIG. 6) synchronized with the data voltage for off-driving.

The gate driver 13 can generate a gate signal for display based on the gate control signal GDC during the driving for display and sequentially supply the gate signal for display to the gate lines 15 (*i*) to 15 (i+3). The gate signal for display is a scan signal for display synchronized with the data voltage for display. The display lines Li to Li+3 are sequentially driven for display by the gate signal for display and the data voltage for display.

In the present disclosure, a sensing driving sequence for sensing the operating point voltage of the light emitting element can be independently performed for each of R, W, G, and B pixels. For example, in the sensing driving sequence of the present disclosure, after sensing R pixels in a line sequential manner, then W pixels can be sensed in the line sequential manner, then G pixels can be sensed in the line sequential manner, then B pixels can be sensed in the line sequential manner for all display lines of the display panel 10.

The timing controller 11 of the present disclosure appropriately controls the operation timings of the panel driver and the sensing unit SU, and overlappingly shifts the sensing driving sequence for at least some display lines in accordance with in the line sequential manner, so that the time required for sensing can be reduced.

The timing controller 11 of the present disclosure appropriately controls supply timings of the data voltage for on-driving and the data voltage for off-driving, so that an overlapping driving method for each block can be implemented, and a line-by-line overlapping driving method can be implemented. The overlapping driving method for each block will be described later with reference to FIG. 8 to FIG. 10. The line-by-line overlapping driving method will be described later with reference to FIG. 11 to FIG. 12.

Figure 4:
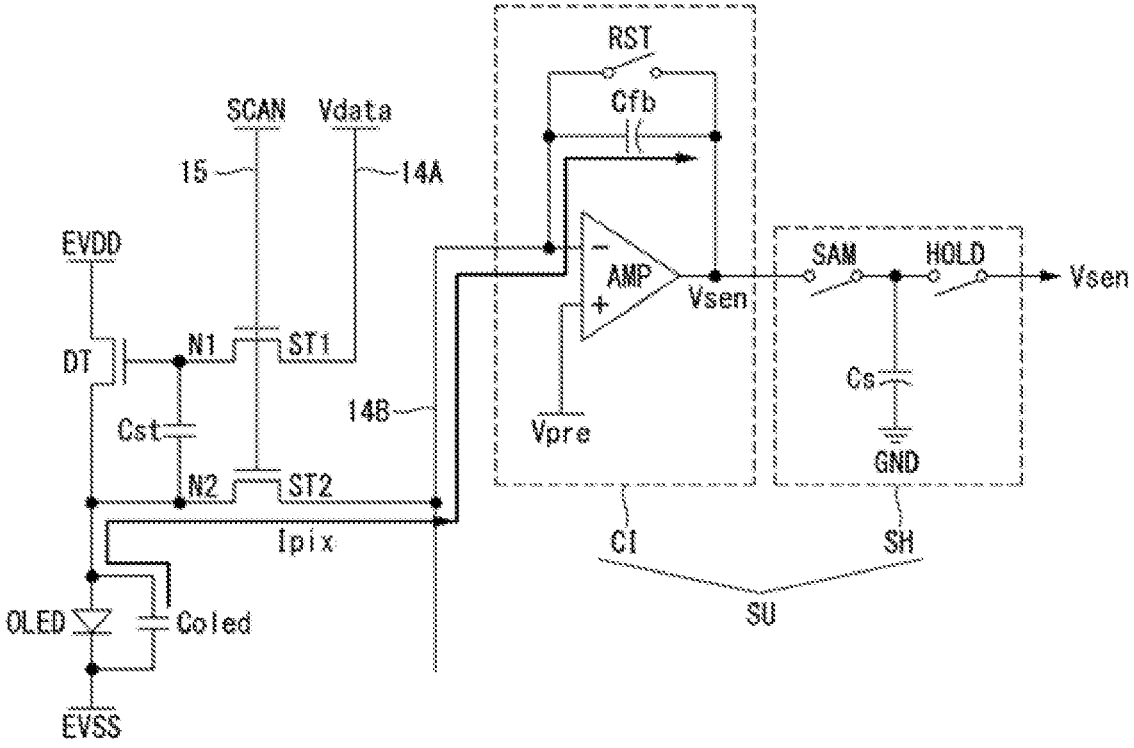
FIG. 4 is a diagram illustrating an example of the configuration of a pixel and a sensing unit in an organic light emitting display according to the present disclosure.

FIG. 4 is a diagram illustrating an example of the configuration of a pixel and a sensing unit in a display device according to the present disclosure. For example, the pixel and the sensing unit of FIG. 4 can be the pixel and sending unit in the display of FIG. 1 or in any other suitable display device. It is to be noted that the technical idea of the present disclosure is not limited to exemplary structures of the pixel P and the sensing unit SU since FIG. 4 is only an example.

Referring to FIG. 4, each pixel P can include an OLED, a driving thin film transistor (TFT) DT, a storage capacitor Cst, a first switching TFT ST1, and a second switching TFT ST2. The TFTs constituting the pixel P can be implemented as a p-type, an n-type, or a hybrid type in which the p-type and the n-type are mixed. In addition, a semiconductor layer of the TFTs constituting the pixel P can include amorphous silicon, polysilicon, or an oxide.

The OLED is a light emitting element that emits light in response to a pixel current. The OLED includes an anode electrode connected to a second node N2, a cathode electrode connected to an input terminal of a low level driving voltage EVSS, and an organic compound layer positioned between the anode electrode and the cathode electrode. A parasitic capacitor Coled exists in the OLED by the anode electrode, the cathode electrode, and a plurality of insulating layers existing therebetween. A capacitance of the parasitic capacitor Coled of the OLED is a few pF, which is very small compared to a parasitic capacitance of a sensing line 14B, which is several hundred to several thousand pF. The present disclosure senses deterioration of the OLED through a current sensing manner using the parasitic capacitor Coled of the OLED. Therefore, compared with a conventional voltage sensing method of sensing a voltage charged in the sensing line 14B, the present disclosure can reduce sensing time and improve sensing accuracy. In other words, since the present disclosure senses charges (corresponding to an operating point voltage of the OLED) accumulated in the parasitic capacitor Coled of the OLED through current sensing, it is advantageous for low current sensing and high-speed sensing.

The driving TFT DT is a driving element for controlling the pixel current input to the OLED depending on a gate-source voltage Vgs. The driving TFT DT includes a gate electrode connected to a first node N1, a drain electrode connected to an input terminal of a high level driving voltage EVDD, and a source electrode connected to the second node N2. The storage capacitor Cst is connected between the first node N1 and the second node N2. The first switching TFT ST1 applies a data voltage Vdata on a data line 14A to the first node N1 in response to a gate signal for sensing SCAN. The data voltage Vdata is a data voltage for sensing, which includes a data voltage for on-driving and a data voltage for off-driving. The first switching TFT ST1 includes a gate electrode connected to a gate line 15, a drain electrode connected to the data line 14A, and a source electrode connected to the first node N1. The second switching TFT ST2 switches a current flow between the second node N2 and the sensing line 14B in response to the gate signal for sensing SCAN. The second switching TFT ST2 includes a gate electrode connected to the gate line 15, a drain electrode connected to the sensing line 14B, and a source electrode connected to the second node N2.

The sensing unit SU is connected to the pixel P through the sensing line 14B. The sensing unit SU can include a current integrator CI and a sample & hold unit SH.

The current integrator CI integrates current information Ipix input from the pixel P and outputs a sensing voltage Vsen. The current information Ipix is a current corresponding to an amount of charge accumulated in the parasitic capacitor Coled of the OLED, and it increases in proportion to the operating point voltage of the OLED. The current integrator CI for outputting the sensing voltage Vsen through an output terminal includes an amplifier AMP, an integral capacitor Cfb connected between an inverting input terminal (−) and an output terminal of the amplifier AMP, and a reset switch RST connected to both ends of the integral capacitor Cfb. The inverting input terminal (−) of the amplifier AMP applies the initialization voltage Vpre to the second node N2 through the sensing line 14B, and receives the charge charged in the parasitic capacitor of the OLED Coled of the pixel P through the sensing line 14B. The initialization voltage Vpre is input to a non-inverting input terminal (+) of the amplifier AMP.

The current integrator CI is connected to an ADC through the sample & hold unit SH. The sample & hold unit SH includes a sampling switch SAM for sampling the sensing voltage Vsen output from the amplifier AMP and storing the sampled voltage Vsen in a sampling capacitor Cs and a holding switch HOLD for transmitting the sensing voltage Vsen stored in the sampling capacitor Cs to the ADC.

Figure 5:
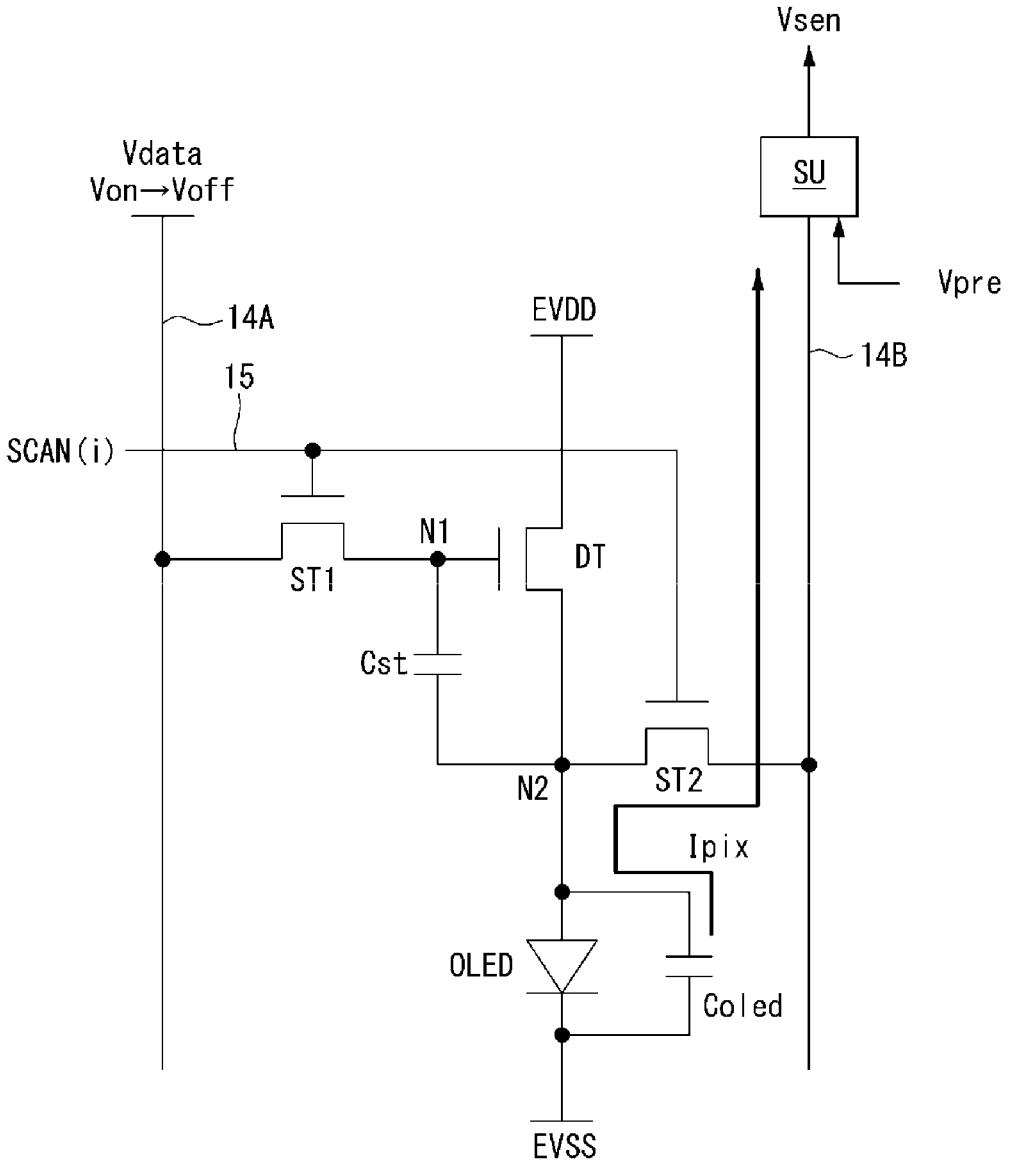
FIGS. 5 and 6 are views for explaining an example of the operation of the pixel and the sensing unit of FIG. 4 when deterioration of a light emitting element is sensed.

FIGS. 5 and 6 are views for explaining an example of the operation of the pixel and the sensing unit of FIG. 4 when deterioration of an OLED is sensed.

Referring to FIGS. 5 and 6, the sensing driving sequence of the present disclosure can be performed in order of an initialization period Ta, a boosting period Tb, and a sampling period Tc.

In the initialization period Ta, due to turn-on of the reset switch RST, the current integrator CI operates as a unit gain buffer having a gain of 1, so that the input terminals (+, −), the output terminal of the amplifier AMP, and the sensing line 14B are all initialized to the initialization Vpre.

In the initialization period Ta, a data voltage for on-driving Von is applied to a data line 14A. A gate signal for sensing SCAN is applied as a first gate pulse P1 of on-level in synchronization with the data voltage for on-driving Von to turn on a first switching TFT ST1 and a second switching TFT ST2. In the initialization period Ta, the first switching TFT ST1 is turned on to apply the data voltage for on-driving Von on the data line 14A to a first node N1. The second switching TFT ST2 is turned on to apply the initialization voltage Vpre on the sensing line 14B to a second node N2. As a result, a gate-source voltage of a driving TFT DT is set so as to allow a pixel current to flow.

In the boosting period Tb, the first switching TFT ST1 and the second switching TFT ST2 are turned off in response to the gate signal for sensing SCAN of off-level. At this time, a potential of the second node N2, that is, an anode potential of an OLED, is boosted up to an operating point voltage of the OLED by the pixel current flowing between a source and a drain of the driving TFT DT and then is saturated at a boosting level. When the anode potential of the OLED is raised to the operating point voltage, the pixel current flows through the OLED and the OLED emits light. At this time, a parasitic capacitor Coled of the OLED is charged with an amount of charge corresponding to the operating point voltage of the OLED. The operating point voltage of the OLED increases in proportion to deterioration of the OLED. Therefore, the amount of charge charged in the parasitic capacitor Coled of the OLED also increases in proportion to the deterioration (Q=Coled*Vanode). On the other hand, in the boosting period Tb, the current integrator CI continues to operate as the unit gain buffer, so that a sensing voltage Vsen is output as the initialization voltage Vpre in the boosting period Tb.

In the sampling period Tc, the first switching TFT ST1 and the second switching TFT ST2 are turned on in response to a second pulse P2 of a gate signal for sensing SCAN having on-level and the reset switch RST is turned off. At this time, a data voltage for off-driving Voff is applied to the data line 14A in synchronization with the second pulse P2 of the gate signal for sensing SCAN. The driving TFT DT is turned off depending on the data voltage for off-driving Voff applied through the first switching TFT ST1. Thus, the pixel current applied to the OLED is cut off. In the sampling period Tc, the pixel current is cut off and the charge charged in the parasitic capacitor Coled of the OLED is sensed. The charge charged in the parasitic capacitor Coled of the OLED moves to the integral capacitor Cfb of the current integrator CI in the sampling period Tc. As a result, the potential of the second node N2 drops from a boosting level to the initialization voltage Vpre. In the sampling period Tc, a potential difference between the both ends of the integral capacitor Cfb is increased by the charge flowing into the inverting input terminal (−) of the amplifier AMP as sensing time elapses, that is, an accumulated amount of charge increases. Since the inverting input terminal (−) and the non-inverting input terminal (+) are short-circuited through a virtual ground and the potential difference between them is zero, a potential of the inverting input terminal (−) is maintained at the initialization voltage Vpre irrespective of an increase in the potential difference of the integral capacitor Cfb in the sampling period Tc. Instead, an output terminal potential of the amplifier AMP is lowered corresponding to the potential difference across the integral capacitor Cfb. With this principle, in the sampling period Tc, the charge flowing through the sensing line 14B is changed to the sensing voltage Vsen which is an integral value through the integral capacitor Cfb and the sensing voltage Vsen can be output as a value lower than the initialization voltage Vpre. This is due to input/output characteristics of the current integrator CI. The greater the potential difference between the boosting level and the initialization voltages Vpre, for example, the higher the operating point voltage of the OLED, the greater potential differences ΔV1 and ΔV2 between the initialization voltage Vpre and the sensing voltage Vsen. In FIG. 6, dotted lines are operating waveforms of a pixel having a relatively high operating point voltage of the OLED, and solid lines are operating waveforms of a pixel having a relatively low operating point voltage of the OLED.

The sensing voltage Vsen is stored in the sampling capacitor Cs through the sampling switch SAM. When the holding switch HOLD is turned on, the sensing voltage Vsen stored in the sampling capacitor Cs is input to the ADC through the holding switch HOLD. The sensing voltage Vsen is converted into sensing data SD by the ADC and then output to the compensation unit 20.

In accordance with the sensing driving sequence, pixels of the same color arranged on each display line can be sensed in the line sequential manner.

Figure 7:
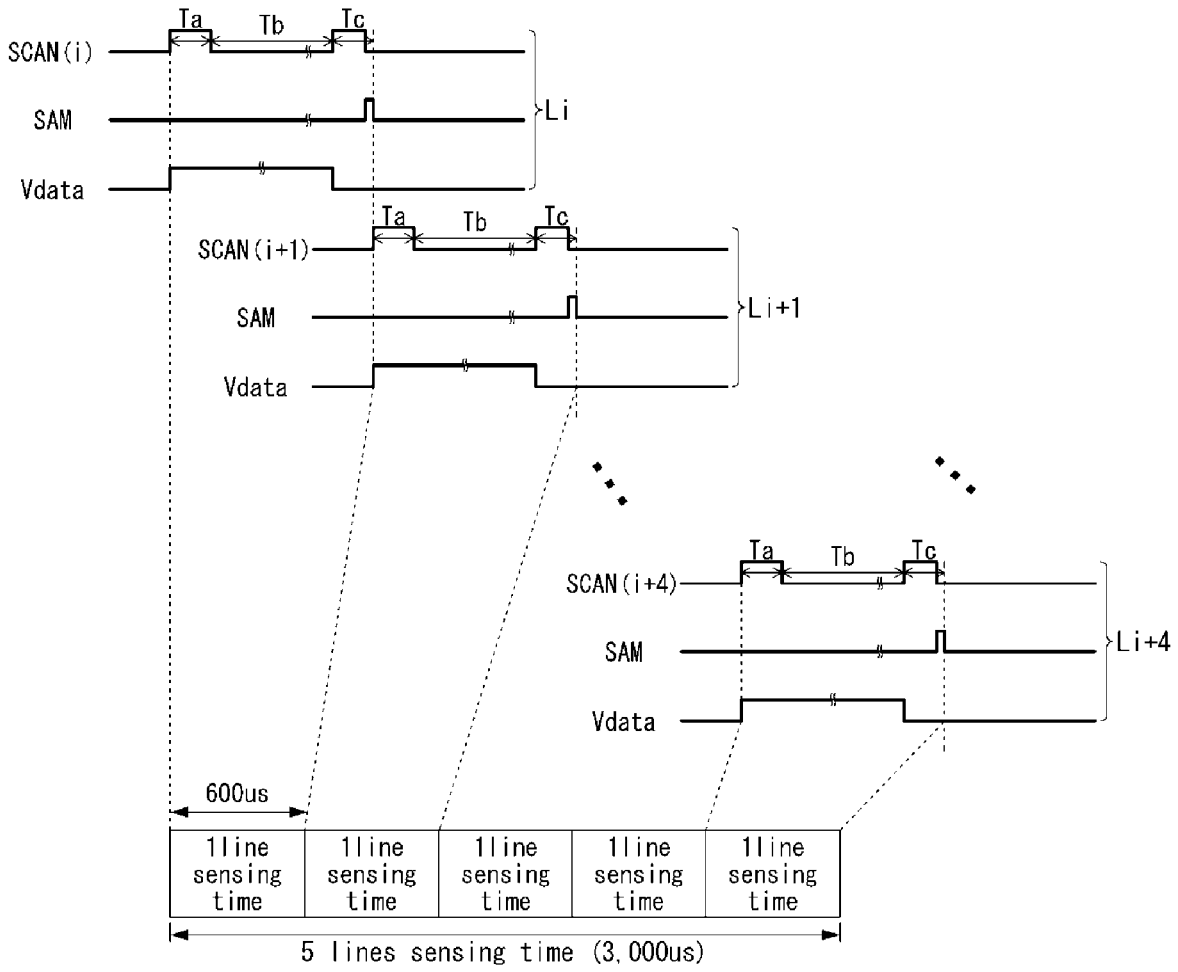
FIG. 7 is a diagram for explaining a sensing driving sequence of an organic light emitting display according to a comparative example of the present disclosure.

FIG. 7 is a diagram for explaining a sensing driving sequence of an organic light emitting display according to a comparative example of the present disclosure.

Referring to FIG. 7, the sensing driving sequence of the organic light emitting display according to a comparative example of the present disclosure non-overlappingly shifts the sensing driving sequence of FIG. 6 for display lines Li to Li+4 in accordance with the line sequential manner.

In other words, after the sensing driving sequence of FIG. 7 completes sensing for first color pixels arranged on the display line Li, it starts sensing for first color pixels arranged on the display line Li+1. Subsequently, after the sensing driving sequence completes sensing for the first color pixels arranged on the display line Li+1, it starts sensing for first color pixels arranged on the display line Li+2. In this way, the sensing driving sequence of FIG. 7 completes sensing for first color pixels arranged on the last display line of the display panel. Second to fourth color pixels are also sensed in the same manner as the first color pixel.

In accordance with such a non-overlapping sensing driving sequence, time required for sensing is long. For example, as shown in FIG. 7, when the time required for sensing specific color pixels for one display line is 600 μs, the time required for sensing specific color pixels for the five display lines Li to Li+4 is 3,000 μs.

Figure 8:
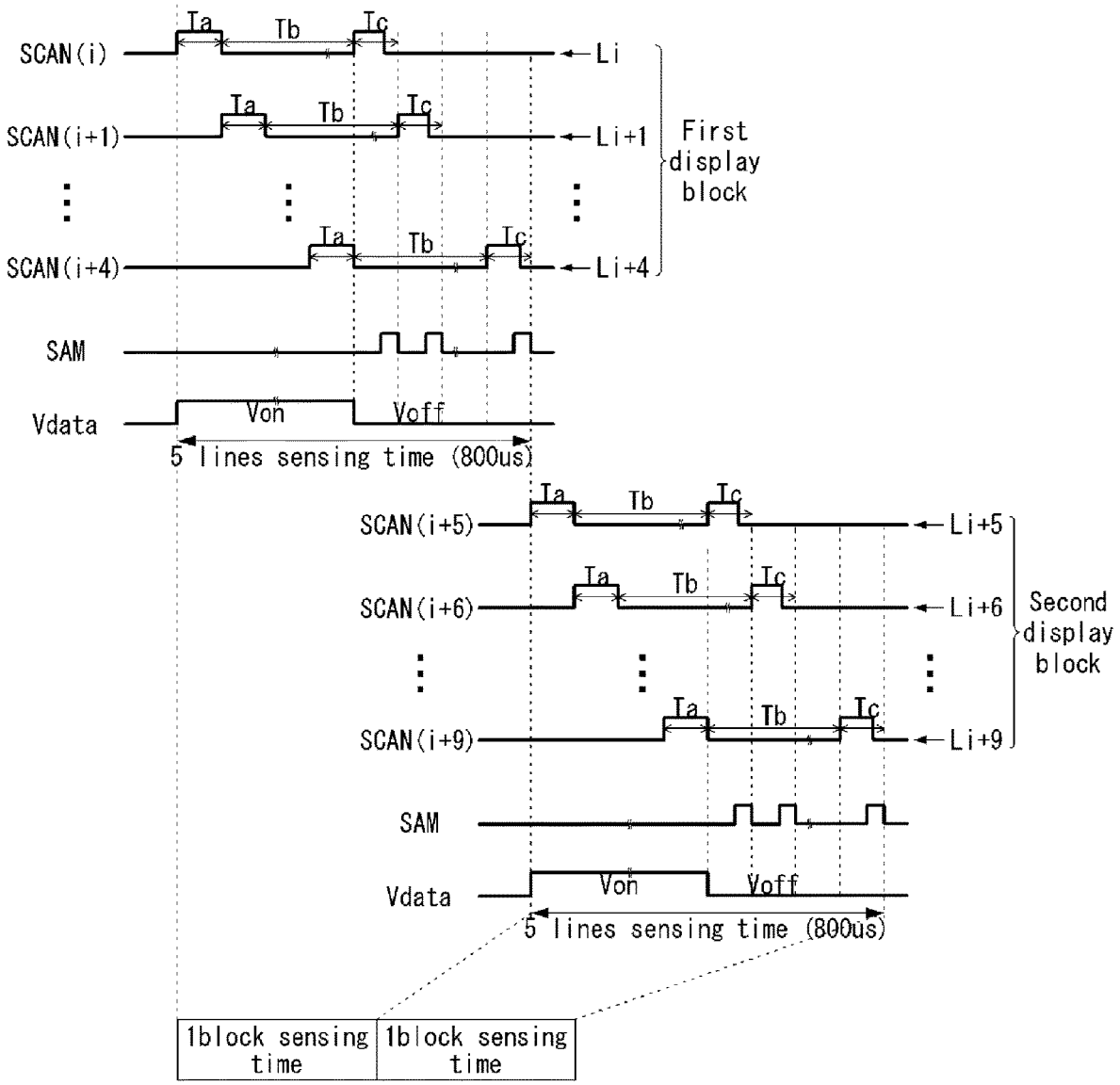
FIGS. 8 to 10 are views for explaining a sensing driving sequence of an organic light emitting display according to an embodiment of the present disclosure.
Figure 9A:
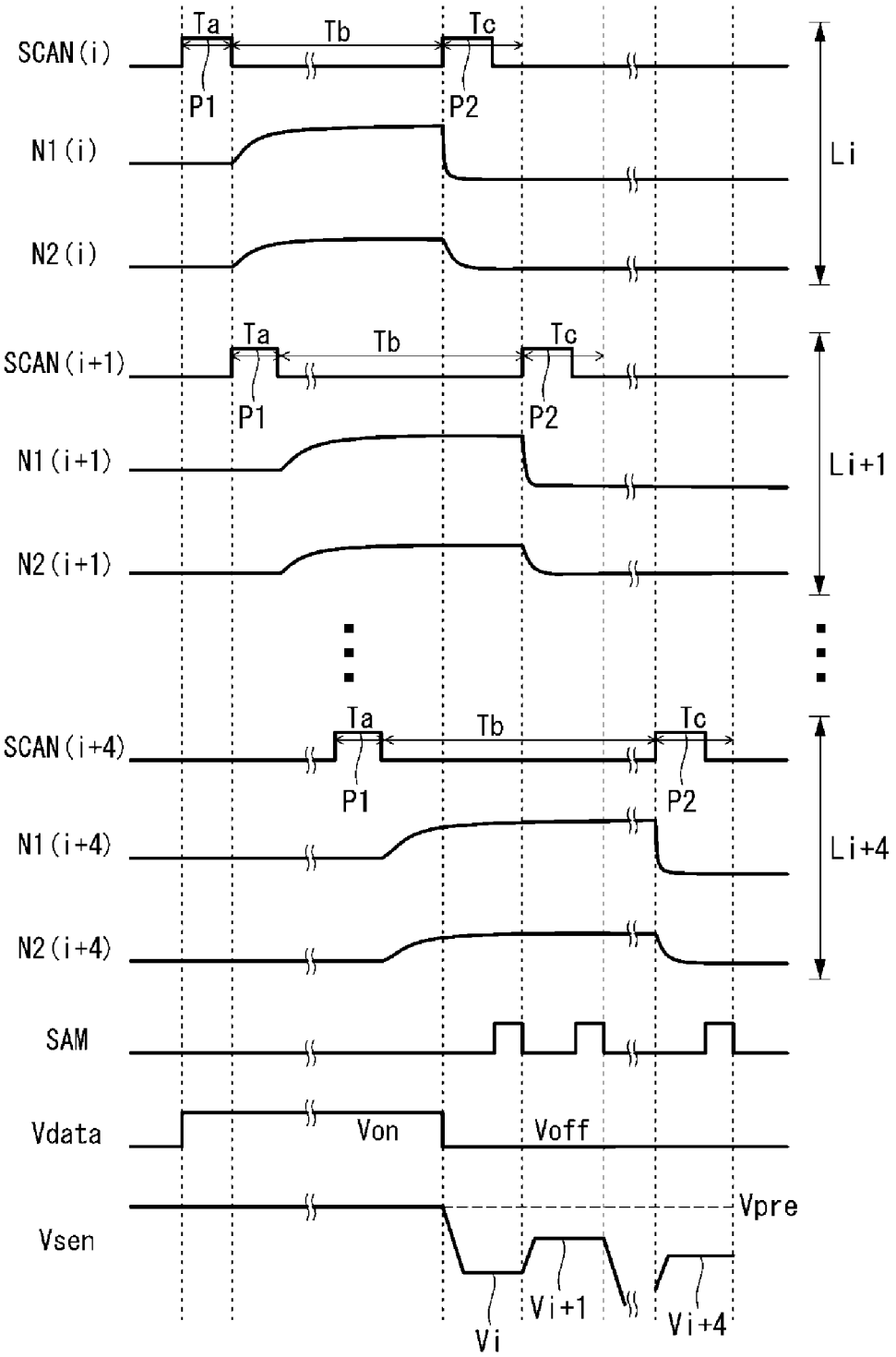
Figure 9B:
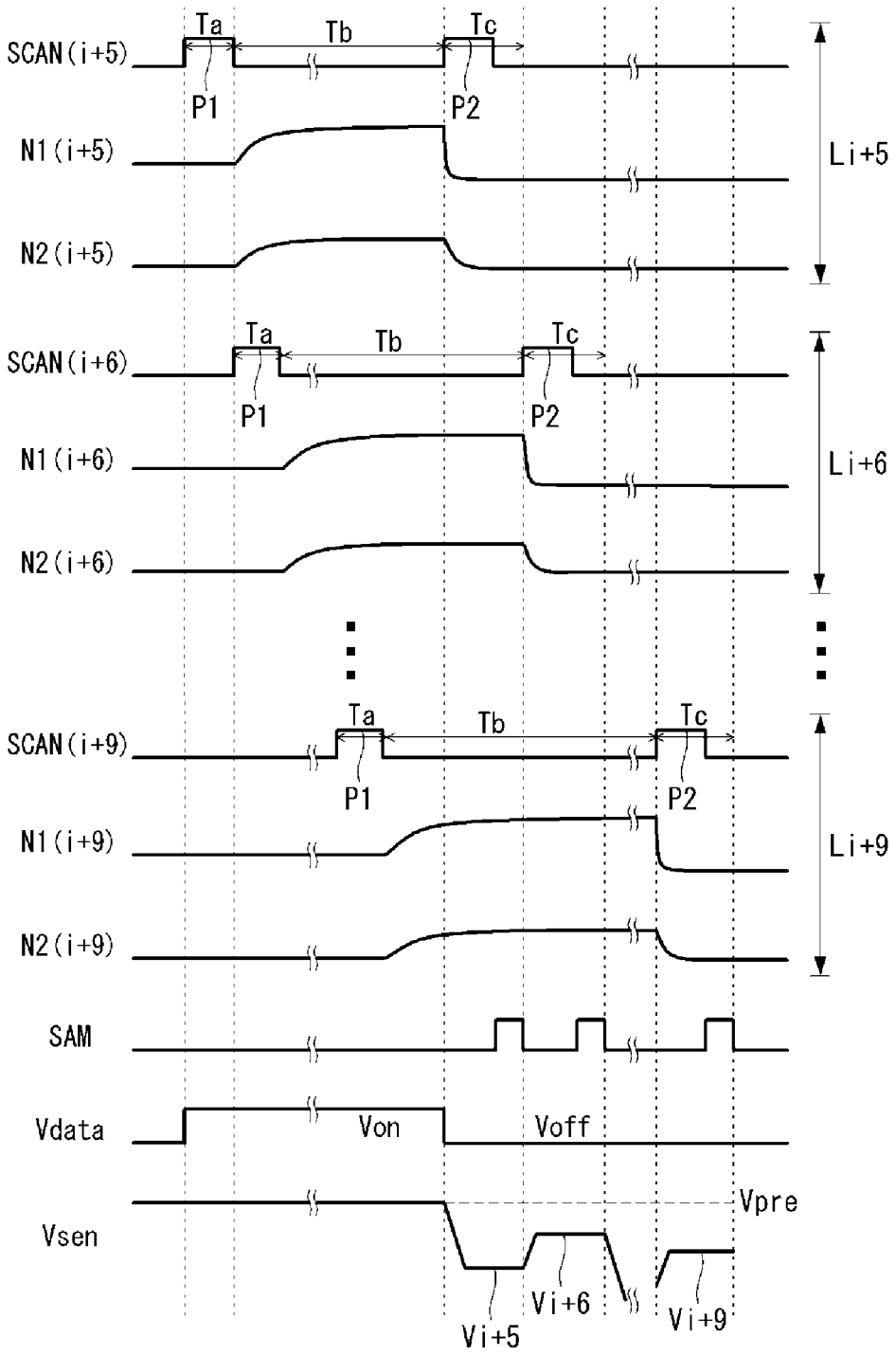
Figure 10:
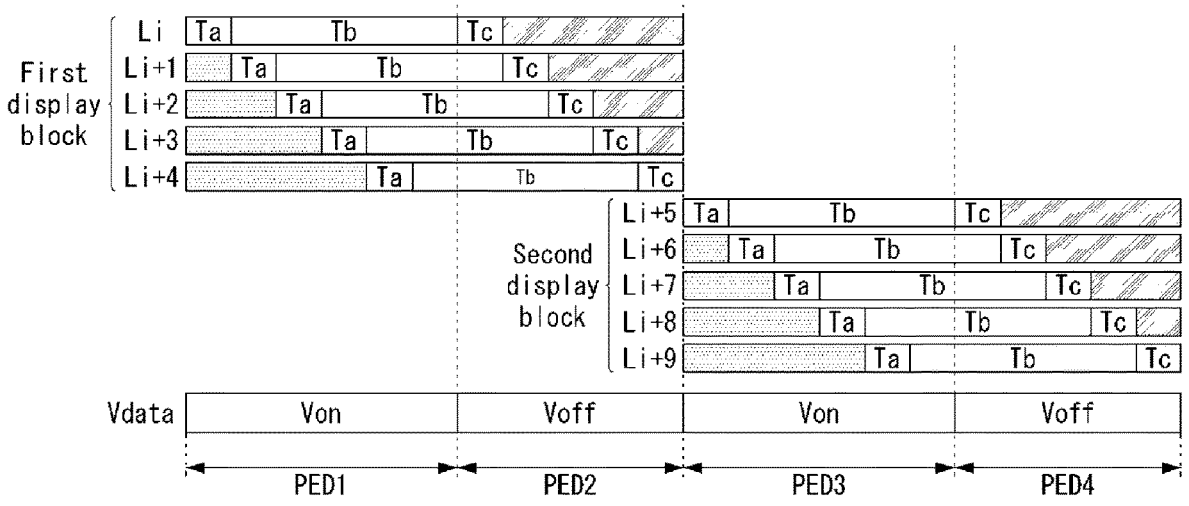

FIGS. 8 to 10 are views for explaining a sensing driving sequence of an organic light emitting display according to an embodiment of the present disclosure.

Referring to FIGS. 8 to 10, the sensing driving sequence of the organic light emitting display according to an embodiment of the present disclosure proposes an overlapping driving method for each block in order to reduce time required for sensing.

Assuming a first display block and a second display block that are continuously driven for sensing as shown in FIG. 8, each of the first and second display blocks can have five display lines (Li to Li+4, Li+5 to Li+9) sequentially driven for sensing in accordance with the sensing driving sequence. At this time, in the overlapping driving method for each block of the present disclosure, initialization periods Ta of second to last display lines (Li+1 to Li+4, or Li+6 to Li+9) which are driven for sensing are sequentially shifted within a boosting period Tb of a first display line (Li or Li+5) which is driven for sensing for each of the first and second display blocks.

In accordance with the overlapping driving method for each block, the time required for sensing specific color pixels for each display block (i.e., the time required for sensing the five display lines) is 800 μs, and the sensing time is reduced to 8/30 compared with the non-overlapping sensing driving sequence of FIG. 7.

However, in the case of the overlapping driving method for each block, the non-overlapping sensing driving sequence is performed between neighboring blocks. In other words, a sampling period Tc of the last display line Li+4 which is driven for sensing in the first display block and an initialization period Ta of the first display line Li+5 which is driven for sensing in the second display block are designed to be non-overlapped.

This is because a data voltage for on-driving Von, a data voltage for off-driving Voff, a first gate pulse P1, and a second gate pulse P2 must be applied in accordance with the sensing driving sequence of each of the first and second display blocks.

To this end, a panel driver (i.e., a data driver) of the present disclosure, as shown in FIGS. 9A and 10, can sequentially supply the data voltage for on-driving Von for setting a pixel current to pixels of the display lines Li to Li+4 belonging to the first display block during a first period PED1, and can sequentially supply the data voltage for off-driving Voff for blocking the pixel current to the pixels of the display lines Li to Li+4 belonging to the first display block during a second period PED2 after the first period PED1. Here, the first period PED1 is a period in which the initialization periods Ta of the display lines Li to Li+4 belonging to the first display block are included. The second period PED2 is a period in which the sampling periods Tc of the display lines Li to Li+4 belonging to the first display block are included.

At this time, a panel driver (i.e., a gate driver) of the present disclosure, as shown in FIGS. 9A and 10, can sequentially supply the first gate pulse P1 synchronized with the data voltage for on-driving Von to the pixels of the display lines Li to Li+4 belonging to the first display block during the first period PED1, and can sequentially supply the second gate pulse P2 synchronized with the data voltage for off-driving Voff to the pixels of the display lines Li to Li+4 belonging to the first display block during the second period PED2.

Accordingly, first to fifth sensing voltages Vi to Vi+4 are output from a sensing unit for the pixels of the display lines Li to Li+4 belonging to the first display block.

The panel driver (i.e., the data driver) of the present disclosure, as shown in FIGS. 9B and 10, can sequentially supply the data voltage for on-driving Von for setting a pixel current to pixels of the display lines Li+5 to Li+9 belonging to the second display block during a third period PED3, and can sequentially supply the data voltage for off-driving Voff for blocking the pixel current to the pixels of the display lines Li+5 to Li+9 belonging to the second display block during a fourth period PED4 after the third period PED3. Here, the third period PED3 is a period in which the initialization periods Ta of the display lines Li+5 to Li+9 belonging to the second display block are included. The fourth period PED4 is a period in which the sampling periods Tc of the display lines Li+5 to Li+9 belonging to the second display block are included.

At this time, the panel driver (i.e., the gate driver) of the present disclosure, as shown in FIGS. 9B and 10, can sequentially supply the first gate pulse P1 synchronized with the data voltage for on-driving Von to the pixels of the display lines Li+5 to Li+9 belonging to the second display block during the third period PED3, and can sequentially supply the second gate pulse P2 synchronized with the data voltage for off-driving Voff to the pixels of the display lines Li+5 to Li+9 belonging to the second display block during the fourth period PED4. In FIGS. 9A-12, the panel drivers can be the panel drivers of the display in FIG. 1 or in other suitable display devices.

Accordingly, sixth to tenth sensing voltages Vi+5 to Vi+9 are output from the sensing unit for the pixels of the display lines Li+5 to Li+9 belonging to the second display block.

Meanwhile, in accordance with the sensing driving sequence of an organic light emitting display according to an embodiment of the present disclosure, a surplus period such as a period indicated by oblique lines and a period indicated by dots is generated in FIG. 10. Since the data voltage for off-driving Voff is applied during the period indicated by oblique lines in FIG. 10, the period indicated by oblique lines cannot be utilized as the initialization periods Ta of a subsequent display block. Also, since the data voltage for on-driving Von is applied during the period indicated by dots in FIG. 10, the period indicated by dots cannot be utilized as the sampling periods Tc of the preceding display block. It is necessary to reduce the surplus period as described above in order to further reduce the time required for sensing.

Figure 11:
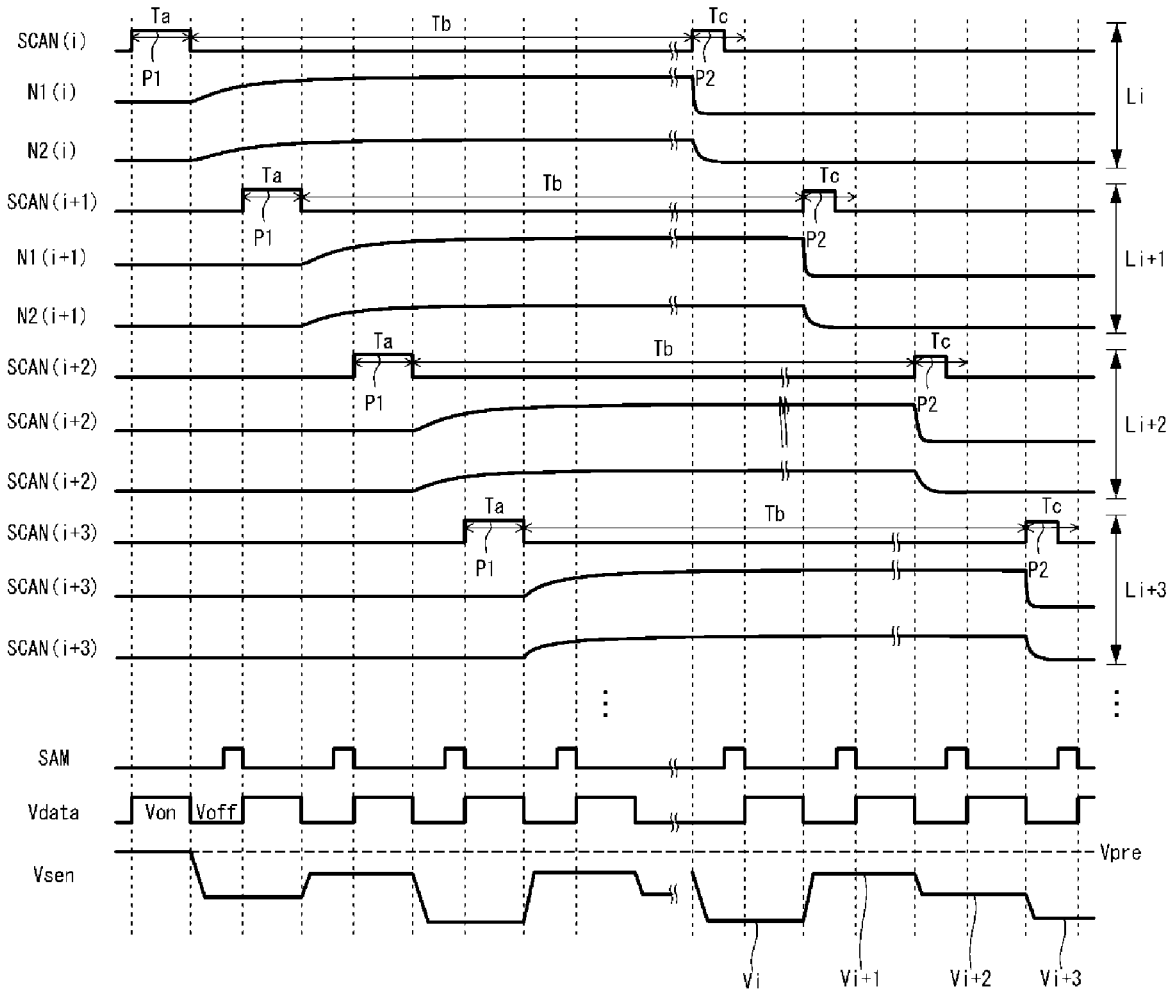
FIGS. 11 and 12 are views for explaining a sensing driving sequence of an organic light emitting display according to another embodiment of the present disclosure.
Figure 12:
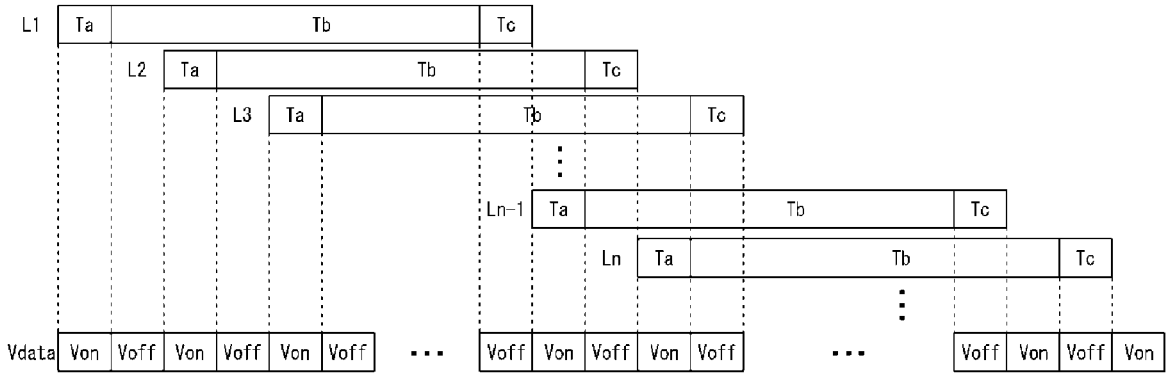

FIGS. 11 and 12 are views for explaining a sensing driving sequence of an organic light emitting display according to another embodiment of the present disclosure.

FIGS. 11 and 12 show an embodiment in which the above-mentioned surplus period can be eliminated or minimized. Referring to FIGS. 11 and 12, the sensing driving sequence of the organic light emitting display according to another embodiment of the present disclosure proposes a line-by-line overlapping driving method to further reduce time required for sensing. In order to implement the line-by-line overlapping driving method, the timing controller of the present disclosure overlappingly shifts the sensing driving sequence for all the display lines in accordance with the line sequential manner.

In accordance with the line-by-line sensing driving sequence, as shown in FIGS. 11 and 12, an initialization period Ta of each of the display lines to be driven for sensing in a subsequent order is set to be within a boosting period Tb of each of the display lines to be driven for sensing in an immediately previous order. In accordance with this line-by-line overlapping driving method, as shown in FIG. 12, since there are no surplus periods, the time required for sensing specific color pixels for each display block is further reduced.

However, in order to implement the line-by-line sensing driving sequence, application timings of a data voltage for on-driving Von and a data voltage for off-driving Voff must be appropriately matched. As a precondition, the data voltage for on-driving Von must be applied for setting a pixel current during an initialization period Ta of each of the display lines Li to Li+3, and the data voltage for off-driving Voff must be applied for blocking the pixel current during a boosting period Tb of each of the display lines Li to Li+3.

To this end, a panel driver (i.e., a data driver) of the present disclosure, as shown in FIG. 11, can sequentially supply the data voltage for on-driving Von for setting a pixel current to pixels of the display lines Li to Li+3 during the initialization period Ta of each of the display lines Li to Li+3, and can sequentially supply the data voltage for off-driving Voff for blocking the pixel current to the pixels of the display lines Li to Li+3 during a sampling period Tc of each of the display lines Li to Li+3.

Alternating cycle of the data voltage for on-driving Von and the data voltage for off-driving Voff in FIG. 12 is shorter than that in FIG. 10.

At this time, a panel driver (i.e., a gate driver) of the present disclosure, as shown in FIG. 11, can sequentially supply a first gate pulse P1 synchronized with the data voltage for on-driving Von to the pixels of the display lines Li to Li+3 during the initialization period Ta of each of the display lines Li to Li+3, and can sequentially supply a second gate pulse P2 synchronized with the data voltage for off-driving Voff to the pixels of the display lines Li to Li+3 during the sampling period Tc of each of the display lines Li to Li+3.

Accordingly, first to fourth sensing voltages Vi to Vi+3 are output from a sensing unit for the pixels of the display lines Li to Li+3. In this way, the pixels of the remaining display lines are also sensed.

As described above, the display of the present disclosure overlappingly shifts the sensing driving sequence for at least some display lines in accordance with the line sequential manner, so that the time required for sensing can be reduced. Accordingly, the present disclosure reduces the sensing time in sensing deterioration of the OLED, thereby minimizing side effects such as sensing line visibility, so that the performance of the display device can be enhanced.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display comprising:

a display panel including a plurality of display lines, each of the display lines in which a plurality of pixels are arranged, each of the pixels including an organic light emitting element and a driving element;

a panel driver configured to supply a gate signal and a data voltage synchronized with the gate signal to the pixels of the display lines;

a sensing unit configured to sense operating voltages output to corresponding organic light emitting elements, the operating voltages corresponding to driving characteristics of the pixels corresponding to a degree of organic light emitting element degradation during a sensing driving sequence; and a timing controller configured to control operation timings of the panel driver and the sensing unit, and overlappingly shift the sensing driving sequence for sensing the degree of organic light emitting element degradation for at least some display lines among the plurality of display lines in accordance with a line sequential manner, wherein the display panel includes a first display block and a second display block that are continuously driven for sensing, wherein each of the first display block and the second display block has K display lines sequentially driven for sensing in accordance with the sensing driving sequence, where K is a natural number of 2 or more, wherein initialization periods of second to Kth display lines which are driven for sensing the degree of organic light emitting element degradation are sequentially shifted within a boosting period of a first display line which is driven for sensing and the initialization periods of the second to Kth display lines terminate before a sampling period of the first display line, and wherein each of the initialization periods corresponds to the gate signal having an on level, and the boosting period corresponds to the gate signal having an off level.

2. The organic light emitting display of claim 1, wherein the sensing driving sequence includes:

an initialization period for setting a pixel current flowing in the driving element according to a sensing data voltage for on-driving;

a boosting period for storing an operating point voltage of the light emitting element depending on the pixel current in a parasitic capacitor of the light emitting element after the initialization period; and a sampling period for sampling the operating point voltage of the light emitting element after the boosting period.

3. The organic light emitting display of claim 2, wherein a sampling period of the Kth display line which is driven for sensing in the first display block and an initialization period of the first display line which is driven for sensing in the second display block are non-overlapped.

4. The organic light emitting display of claim 3, wherein the panel driver sequentially supplies the sensing data voltage for on-driving for setting the pixel current to pixels of the display lines belonging to the first display block during a first period, wherein the panel driver sequentially supplies a sensing data voltage for off-driving for blocking the pixel current to the pixels of the display lines belonging to the first display block during a second period after the first period, wherein initialization periods of the display lines belonging to the first display block are included in the first period, and wherein sampling periods of the display lines belonging to the first display block are included in the second period.

5. The organic light emitting display of claim 4, wherein the panel driver sequentially supplies a first gate pulse synchronized with the sensing data voltage for on-driving to the pixels of the display lines belonging to the first display block during the first period, and wherein the panel driver sequentially supplies a second gate pulse synchronized with the sensing data voltage for off-driving to the pixels of the display lines belonging to the first display block during the second period after the first period.

6. The organic light emitting display of claim 3, wherein the panel driver sequentially supplies the sensing data voltage for on-driving to pixels of the display lines belonging to the second display block during a third period, wherein the panel driver sequentially supplies a sensing data voltage for off-driving to the pixels of the display lines belonging to the second display block during a fourth period after the third period, wherein initialization periods of the display lines belonging to the second display block are included in the third period, and wherein sampling periods of the display lines belonging to the second display block are included in the fourth period.

7. The organic light emitting display of claim 6, wherein the panel driver sequentially supplies a first gate pulse synchronized with the sensing data voltage for on-driving to the pixels of the display lines belonging to the second display block during the third period, and wherein the panel driver sequentially supplies a second gate pulse synchronized with the sensing data voltage for off-driving to the pixels of the display lines belonging to the second display block during the fourth period after the third period.

8. The organic light emitting display of claim 1, wherein the timing controller overlappingly shifts the sensing driving sequence for all the display lines in accordance with the line sequential manner.

9. The organic light emitting display of claim 8, wherein an initialization period of each of the display lines to be driven for sensing in a subsequent order is set to be within a boosting period of each of the display lines to be driven for sensing in an immediately previous order.

10. The organic light emitting display of claim 9, wherein the panel driver sequentially supplies the sensing data voltage for on-driving for setting the pixel current to pixels of the display lines during the initialization period of each of the display lines, and wherein the panel driver sequentially supplies a sensing data voltage for off-driving for blocking the pixel current to the pixels of the display lines during the sampling period of each of the display lines.

11. The organic light emitting display of claim 10, wherein the panel driver sequentially supplies a first gate pulse synchronized with the sensing data voltage for on-driving to the pixels of the display lines during the initialization period of each of the display lines, and wherein the panel driver sequentially supplies a second gate pulse synchronized with the sensing data voltage for off-driving to the pixels of the display lines during the sampling period of each of the display lines.

12. A method of sensing deterioration of an organic light emitting display including a display panel including a plurality of display lines, each of the display lines in which a plurality of pixels are arranged, each of the pixels including an organic light emitting element and a driving element, the method comprising:

a panel driving step of supplying a gate signal and a data voltage synchronized with the gate signal to the pixels of the display lines;

sensing operating voltages output to corresponding organic light emitting elements, the operating voltages corresponding to driving characteristics of the pixels corresponding to a degree of organic light emitting element degradation during a sensing driving sequence; and controlling operation timings of the panel driving step and the sensing, and overlappingly shifting the sensing driving sequence for sensing the degree of organic light emitting element degradation for at least some display lines among the plurality of display lines in accordance with a line sequential manner, wherein the display panel includes a first display block and a second display block that are continuously driven for sensing, wherein each of the first display block and the second display block has K display lines sequentially driven for sensing in accordance with the sensing driving sequence, where K is a natural number of 2 or more, wherein the overlappingly shifting the sensing driving sequence for the at least some display lines includes sequentially shifting initialization periods of second to Kth display lines which are driven for sensing the degree of organic light emitting element degradation within a boosting period of a first display line which is driven for sensing and the initialization periods of the second to Kth display lines terminate before a sampling period of the first display line, and wherein each of the initialization periods corresponds to the gate signal having an on level, and the boosting period corresponds to the gate signal having an off level.

13. The method of claim 12, wherein the sensing driving sequence includes:

an initialization period for setting a pixel current flowing in the driving element according to a sensing data voltage for on-driving;

a boosting period for storing an operating point voltage of the light emitting element depending on the pixel current in a parasitic capacitor of the light emitting element after the initialization period; and a sampling period for sampling the operating point voltage of the light emitting element after the boosting period.

14. The method of claim 13, wherein the overlappingly shifting the sensing driving sequence for the at least some display lines further includes:

non-overlapping a sampling period of the Kth display line which is driven for sensing in the first display block and an initialization period of the first display line which is driven for sensing in the second display block.

15. The method of claim 14, wherein the panel driving step includes:

sequentially supplying the sensing data voltage for on-driving for setting the pixel current to pixels of the display lines belonging to the first display block during a first period; and sequentially supplying a sensing data voltage for off-driving for blocking the pixel current to the pixels of the display lines belonging to the first display block during a second period after the first period, wherein initialization periods of the display lines belonging to the first display block are included in the first period, and wherein sampling periods of the display lines belonging to the first display block are included in the second period.

16. The method of claim 15, wherein the panel driving step further includes:

sequentially supplying a first gate pulse synchronized with the sensing data voltage for on-driving to the pixels of the display lines belonging to the first display block during the first period; and sequentially supplying a second gate pulse synchronized with the sensing data voltage for off-driving to the pixels of the display lines belonging to the first display block during the second period after the first period.

17. The method of claim 14, wherein the panel driving step includes:

sequentially supplying the sensing data voltage for on-driving to pixels of the display lines belonging to the second display block during a third period; and sequentially supplying a sensing data voltage for off-driving to the pixels of the display lines belonging to the second display block during a fourth period after the third period, wherein initialization periods of the display lines belonging to the second display block are included in the third period, and wherein sampling periods of the display lines belonging to the second display block are included in the fourth period.

18. The method of claim 17, wherein the panel driving step further includes:

sequentially supplying a first gate pulse synchronized with the sensing data voltage for on-driving to the pixels of the display lines belonging to the second display block during the third period; and sequentially supplying a second gate pulse synchronized with the sensing data voltage for off-driving to the pixels of the display lines belonging to the second display block during the fourth period after the third period.

19. The method of claim 12, wherein the overlappingly shifting the sensing driving sequence for the at least some display lines includes:

overlappingly shifting the sensing driving sequence for all the display lines in accordance with the line sequential manner.

20. The method of claim 19, wherein the overlappingly shifting the sensing driving sequence for all the display lines includes:

setting an initialization period of each of the display lines to be driven for sensing in a subsequent order to be within a boosting period of each of the display lines to be driven for sensing in an immediately previous order.

21. The method of claim 20, wherein the panel driving step includes:

sequentially supplying the sensing data voltage for on-driving for setting the pixel current to pixels of the display lines during the initialization period of each of the display lines; and sequentially supplying a sensing data voltage for off-driving for blocking the pixel current to the pixels of the display lines during the sampling period of each of the display lines.

22. The method of claim 21, wherein the panel driving step further includes:

sequentially supplying a first gate pulse synchronized with the sensing data voltage for on-driving to the pixels of the display lines during the initialization period of each of the display lines; and sequentially supplying a second gate pulse synchronized with the sensing data voltage for off-driving to the pixels of the display lines during the sampling period of each of the display lines.

* * * * *